United States Patent [19]

Griset, Jr.

[11] 4,231,219

[45] Nov. 4, 1980

[54] METHOD AND APPARATUS FOR ALLEVIATING TIGHT SPOTS IN FALSE TWIST TEXTURED YARN

[75] Inventor: Ernest J. Griset, Jr., Asheville, N.C.

[73] Assignee: Akzona Incorporated, Asheville, N.C.

[21] Appl. No.: 44,995

[22] Filed: Jun. 4, 1979

[51] Int. Cl.[3] ..... D02G 1/20; D02G 1/04

[52] U.S. Cl. ..... 57/290; 57/288; 57/334

[58] Field of Search ..... 57/284, 282, 286, 287, 57/288, 290, 310, 328, 334, 331, 337, 342, 343, 346, 347, 348

[56] References Cited

U.S. PATENT DOCUMENTS

| | | | |
|---|---|---|---|
| Re. 28,117 | 8/1974 | Rice | 57/334 X |
| 3,404,525 | 10/1968 | Tompkins | 57/287 X |
| 3,457,338 | 7/1969 | Lefevre | 57/334 X |
| 3,686,845 | 8/1972 | Okada et al. | 57/290 |
| 3,735,575 | 5/1973 | Hattori | 57/334 X |
| 3,777,469 | 12/1973 | Spurgeon | 57/290 X |
| 3,782,088 | 1/1974 | Bakewell | 57/288 |

*Primary Examiner*—Donald Watkins
*Attorney, Agent, or Firm*—Craig & Antonelli

[57] ABSTRACT

A method for alleviating tight spots in false twist textured yarn includes the steps of feeding a thermoplastic multi-filament yarn to a false twister, imparting a false twist to the yarn in one direction, setting the twist to provide a latent torque in the yarn, and thereafter passing the yarn around a tapered flange of a freely rotatable roller to impart a twist in the yarn of a direction opposite to that of the false twist imparted by the twister and of a magnitude sufficient to alleviate tight spots occurring in the yarn during passage through said false twister.

11 Claims, 4 Drawing Figures

METHOD AND APPARATUS FOR ALLEVIATING TIGHT SPOTS IN FALSE TWIST TEXTURED YARN

This invention relates to a method for reducing tight spots in false twist textured yarn and to an apparatus for carrying out this method.

BACKGROUND OF THE INVENTION

In the manufacture of false twist textured yarn, the yarn strand is normally passed through a false twist spindlette which mechanically imparts a physical twist to the yarn. The twist imparted to the yarn backs up opposite to the direction of the yarn travel into a heated zone such as provided by a heated chamber or hot plate and the twist in the yarn is set to produce a torque in the yarn. When the strand of yarn emerges from the spindlette, substantially all of the imparted twist disappears opposite to the original twist inserted and the torque is retained in the yarn. This procedure is well known and disclosed in many patents, e.g. U.S. Pat. No. 2,777,276 and U.S. Pat. No. 3,267,657. Also, it is known to impart false twist to yarns, particularly thermoplastic synthetic yarns, by using a friction false twisting device. In these devices, the twist is imparted to the yarn by frictional contact between the yarn and a rotating surface. Examples of such false twisting devices are shown in U.S. Pat. Nos. 3,094,834; 3,227,461; 3,327,463; 3,816,993 and 3,872,661.

It has been found that in some instances, particularly with the use of a spindlette, small spots of the imparted twist along the yarn do not cancel out and are referred to as "tight spots." These spots usually occur when the imparted twist has not been completely and uniformly removed during passage through the spindlette. Also, the tight spots may result from fusion of adjacent filaments in the original twisted configuration during the heat setting operation or from retention of the reverse twist imparted to the yarn emerging from the spindlette at a weak portion of the yarn. Thus, the tight spot may have either a "Z" or "S" twist configuration. The tight spots are particularly objectionable because they cause distortion in the surface characteristics of a fabric produced from the yarn. Heretofore, devices such as off-set pins have been used below the spindlette to assist in the removal of the originally imparted twist by drawing the strand over the pins under pressure. Although the off-set pin method has helped to some degree, it is not completely satisfactory since several tight spots remain and the tension of the yarn on the pins tends to give poor fiber quality. Also, U.S. Pat. No. 3,338,830 discloses the use of a textile lubricating composition to reduce the number of tight spots in a false twisted yarn.

In accordance with the present invention means are provided for more uniformly cancelling the original twist from the yarn strand as the yarn emerges from the spindlette without adversely reducing the torque. More particularly, the method and apparatus of the present invention uses a tapered flange, yarn-driven, roller which serves to remove or reduce the tight spots occurring in the yarn.

It has been known to use a roller having a tapered flange or conical portion in order to create torque in a running length of continuous multi-filament yarn. In particular, U.S. Pat. No. 3,559,391 discloses an apparatus for the production of torque yarn wherein the twisting means comprises a freely rotatable or yarn-driven, roller having a cylindrical yarn driven end and a tapered or conical yarn twisting end for imparting twist to the yarn. In accordance with this patent synthetic thermoplastic yarn is passed in one or more helical wraps about the freely rotatable roller so that the yarn has a total angular contact of at least 360° with the roller. As disclosed in this patent, a yarn of nylon, polyester or the like is fed from a yarn package by feed rollers over a stationary guide and from the guide the yarn is passed to a heating means such as a heated roller or the like which serves as a twist setting means. Then, the heated yarn is passed around the freely rotatable tapered roller and a driven roller or godet and subsequently passed to a wind-up package or a like device. As disclosed in column 6, beginning with line 40 of this patent, the freely rotatable, tapered roller is mounted substantially perpendicular to a supporting surface and is arranged with respect to the means feeding the yarn thereto so that the yarn will be urged across the tapered twisting portion of the roller designed to impart optimum helical twist characteristics to the yarn upstream between the roller and the twist setting means. In this arrangement, the tapered roller is used to impart all the twist required for the production of the torque yarn.

The patent to Gilchrist (U.S. Pat. No. 3,656,288) discloses a method and apparatus for texturing, i.e. crimping, a yarn wherein the yarn is subjected to a first false twisting operation in one direction in which the yarn is heated in the first twisting configuration and then the yarn is subjected to a second false twisting operation in the opposite direction without further heating. In this method the yarn is oppositely twisted by the second false twisting operation while the yarn still possesses sufficient heat to be at least permanently deformable. As described in this patent, the method of crimping includes heating the yarn, subjecting the yarn to a first false twisting operation in one direction and then immediately subjecting the yarn to a second false twisting operation in the opposite direction, with the twist imparted by the two false twisting operations usually being equal in magnitude so as to superimpose an opposite crimp onto the initially applied crimp in the yarn. Patentees particularly point out at the top of column 5, that crimped yarn is obtained which, compared to conventional single false twist crimped yarn, has greatly reduced or even zero torque, less stretch, but good bulkiness and has no tendency to snarl. In all the examples in this patent, the yarn was twisted to the same number of turns per inch in each false twisting operation, with the second false twisting operation applying the twist in opposite direction to the first. It is, therefore, apparent that a primary purpose of this patent is to provide a method for producing a substantially non-torque crimped yarn which will overcome the disadvantages of the yarn produced by conventional crimping techniques, that is, such yarns have high torque so that when knitted they tend to produce a fabric of high spirality.

There are other patents which also disclose processes and apparatus for imparting successive texturing operations to a yarn wherein one or more false twisting devices are employed.

The patent to Stutz (U.S. Pat. No. 3,543,505) relates to a process for effecting relaxation of the internal tensions of a synthetic textile yarn which has been textured by a first temporary high twisting (a first false-twisting operation) and heat setting in the high twisted state and which has been subjected to a second heat treatment to reduce the elasticity by submitting the yarn to another temporary high-twisting (i.e., a second false twisting) in a direction opposite to that of the first high-twisting and without further heat treatment. As described in the examples of this patent, the second false-twisting step is effected at approximately the same high twist level as the first false twisting step.

Another patent to Stutz (U.S. Pat. No. 3,726,073) discloses a process for compensating internal stresses in a false twisted yarn which is described as overcoming disadvantages of the process of U.S. Pat. No. 3,543,505. In this process both high twisting treatments are effected by a combined false-twisting device having a twist tube and a friction twist imparter driven by a common drive roller. The further twist imparter employs a pair of O-rings at opposite ends of a tubular element for imparting the second high twist treatment to the yarn.

U.S. Pat. No. 3,874,156 discloses a dual yarn texturing operation wherein a yarn is simultaneously subjected to edge crimping and to false twisting to provide an unbalanced high crimp yarn having lower torque than that of conventional yarns of the equal crimp produced by a false twister alone.

SUMMARY OF THE INVENTION

It is an object of the present invention to provide a method and apparatus for eliminating the large number of tight spots that occur during the conventional false twisting of multi-filament polymeric yarns such as nylon, polyester, and the like, with a false twister, without reducing the torque or adversely affecting the bulkiness, tenacity, elongation or other properties exhibited by the yarn obtained from the conventional false twisting operation.

It is another object of the present invention to provide a method and apparatus for eliminating tight spots from false twist textured polymeric yarns which can be readily adapted to existing false twisting apparatus and methods without incurring great expense or time-consuming modifications of these existing apparatus and methods.

Advantageously, the method and apparatus of this invention fully satisfy the above objects by providing a tapered flange roller which is positioned immediately downstream of a conventional false twist device, such as a spindlette, and which is threaded by the yarn in such a manner as to be driven by the yarn alone. This roller has a tapered flange portion at one end which serves to impart twist into the yarn and a cylindrical portion at the other end which serves to retain the yarn in position on the roller and to drive the roller. The roller is mounted to freely rotate about its axis. Assuming that the twist applied in the twisting-setting zone of a conventional false twist assembly is in the "Z" direction, then the tapered flange roller or conical roller is threaded to rotate counterclockwise as one faces the small end of the tapered flange. In this manner the roller tends to impart as "S" twist in the yarn as the yarn slides over the roller. This "S" twist, which is opposite to the original "Z" twist, assists in further cancelling the twist backed up to the twist-setting zone and reduces the number of tight spots remaining in the yarn. Advantageously, it has been found that the frictional forces applied to the outer filaments of the yarn as the yarn passes over the tapered or conical portion of the roller, tend to scrub or open up the filaments so that the original torque is more uniformly retained throughout the length of the yarn. It will be understood that these frictional forces are applied for a relatively prolonged period of time as compared with that contact time within the spindlette or like twister.

More particularly, this invention contemplates a method for alleviating the formation of tight spots in false twist textured yarn which comprises feeding a thermoplastic multi-filament yarn to a twist-setting zone; passing the yarn from the twist-setting zone through a false twister which imparts an original twist to the yarn in a given direction, so that a twisted yarn portion backs up opposite to the direction of the yarn travel into the twist-setting zone and the twist is set, and which acts to cause the original twist imparted to the yarn to disappear as the yarn emerges from the twister; and thereafter passing the yarn around a tapered flange of a roller to impart a twist to the yarn of a direction opposite to that of the original imparted twist and of a magnitude sufficient to alleviate tight spots occurring in the yarn during passage through said false twister.

It has been found that the position of the tapered flange roller with respect to the yarn travel is of importance. Generally, the axis of the roller must be tilted to form an angle of from 60° to 80° with the vertical path of the yarn emerging from the false twister in order to insure ease in the thread-up operation and to provide sufficient friction to twist the yarn and to drive the roller.

Also, the tapered flange roller is arranged to contact the yarn close to the outer edge of the flange portion of the roller to provide prolonged contact between the yarn and the flange portion. In this manner the tapered flange imparts sufficient frictional force to the periphery of the yarn to open-up the yarn in a direction opposite to the original twist and prevent the formation of tight spots. The yarn is wrapped 360° around the roller.

It is also of importance to provide the roller with a large enough taper to promote rapid thread-up and retention of the yarn on the roller. Generally the tapered flange has a taper angle of from 25° to 50°, with 30° to 40° being the preferred range.

The surface of the roller must have a finish that will provide sufficient friction to twist the yarn and yet not damage the yarn, e.g. cause fraying or otherwise break the filaments. A flame coated chromium oxide finish with a 150 RMS rating has been found to be particularly suitable for a roller formed of an aluminum-titanius oxide.

It will be recognized that the twist imparted to the yarn by the tapered flange roller is dependent on the direction of yarn thread-up, the surface characteristics of the roller, the degree of taper and the angle of inclination or tilt of the axis of the roller. In general, these parameters are selected so that the roller will impart from 10 to 20 turns per inch to the yarn in a direction opposite to the twist imparted to the yarn by the false twister. This twist level has been found to be sufficient to reduce the formation of the tight spots to a very acceptable value.

This invention is also directed to an apparatus for effecting the method of alleviating the formation of tight spots during the false twisting operation. As heretofore described, the improvement provided by this invention is to be used on existing equipment. Accordingly, the apparatus of this invention comprises a conventional false twisting assembly having feed rollers, a heater means for providing the heat to the twist-setting zone, a false twister, i.e. a spindlette, a pair of tensioning or draw rolls, an oven and a take-up packaging device; the tapered flange roller; and means for supporting the roller between the false twister and the tensioning rolls along the path of the yarn.

In order to facilitate the thread-up operation required for utilizing the tapered flange roller with the false twisting assembly, it is advantageous to provide the support means for the roller with a shield that determines that the roller will be thread-up in the proper direction, i.e. in the "Z" or "S" direction. This shield is an arcuate, semi-cylindrical element mounted with its axis concentric to the axis of the roller, so that one side of the roller is covered.

Also, it is also proposed in accordance with this invention to provide the tapered flange portion of the roller with means for preventing the yarn from slipping off of the tapered flange or conical portion of the roller during the false twisting operation. This means may be in the form of a stationary disc that is mounted adjacent to the flange portion on a shaft supporting the roller. The disc has a diameter slightly larger than the diameter of the end of the tapered flange portion of the roller.

The method and apparatus of this invention will be further understood from the following detailed description and the accompanying drawings wherein.

Figure 1:
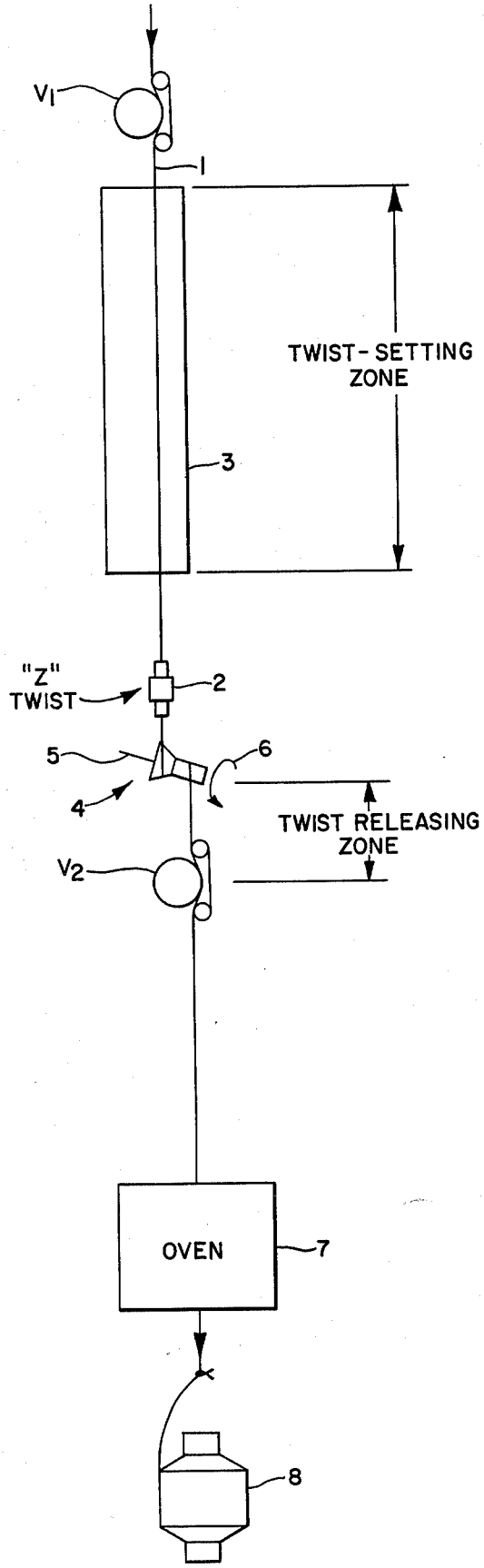
FIG. 1 is a schematic representation of the location of the tapered flange roller in a conventional yarn false twisting assembly.

In FIG. 1, a multi-filament polymeric yarn 1 such as a polyester yarn is fed by roll $V_1$ to a spindlette 2, which imparts a "Z" twist to the yarn. This twist backs up in a direction opposite to the yarn travel to the heater plate 3 which forms a twist-setting zone for the yarn. The plate is heated to a temperature ranging from 180° to 210° C. for processing of a polyester yarn. Subsequently, the yarn is passed from the spindlette to a yarn tensioning roll $V_2$. The yarn is fed through a casablanca type roll in the same manner as roll $V_1$, with the speed of $V_2$ usually being from 150 to 300 percent greater than $V_1$ to effect some drawing of the yarn, if desired, to enhance the tenacity of the yarn. However, these rolls may be operated at substantially the same speed if the yarn supplied has already been drawn. Since a "Z" twist is applied to the yarn by the spindlette 2, the yarn is threaded-up on the tapered flange roller 4 in a counterclockwise direction as indicated by arrow 6 to impart an "S" twist to the yarn emerging from the spindlette. The roller is mounted to freely rotate on a shaft 5 which is inclined or tilted at an angle of approximately 70° with respect to the vertical path of the yarn emerging from spindlette 2.

The tapered flange end of the roller has a taper angle of 40° and the diameter of the outer edge of the flange usually is in the range of from 0.5" to 1.5"; whereas the diameter of the cylindrical end of the roller may vary from 0.25" to 0.75".

The yarn is taken from the tensioning roll $V_2$ and passed through an oven 7 wherein the yarn is heated, in a conventional manner, at temperatures on the order of from 155° to 212° C. prior to being packaged on a take-up unit 8.

It will be appreciated that the zone between tensioning roll $V_2$ and the tapered flange roller 4 provides a twist releasing zone that assists in the release of the original twist imparted to the yarn upstream of the spindlette. The tapered flange roller is usually placed closely subjacent to the spindlette because of space limitations in existing twister assemblies. Generally the distance may vary from 1 inch to 6 inches.

In accordance with this invention a number of Scragg Superdrawset yarn texturing machines were equipped with the tapered flange roller for removing tight spots. Samples of yarn were false twisted using the apparatus equipped with the rollers and identical apparatus without the rollers. In these runs a 170/32 polyester yarn was processed and evaluated for tight spots. The rollers were placed immediately downstream of the false twister units. The tight spots resulting from nine separate runs are listed as follows:

TABLE 1

| TIGHT SPOTS | |
|---|---|
| Control (without rollers) | Yarn Samples (with rollers) |
| 26 | 2 |

Further alleviation of tight spots by the tapered flange roller of the present invention was evaluated in another false twister apparatus using a spidlette and an arrangement of the type shown in FIG. 1 of the drawings. In this arrangement two spindlettes are arranged in parallel so that two separate yarns can be processed over a single heater plate. The tapered flange roller was located between the spindlette and the $V_2$ roller at a distance of 1.5 inches from the spindlette in each run. A full tube doff was processed from a left and right position, using this arrangement. After removal of the tapered flange roller another full tube doff was taken as a control sample. In this apparatus the yarns were each initially given a "Z" false twist of 69 turns per inch and the tapered flange rollers impart an "S" twist of 15 turns per inch. The results obtained using a 170/32 SD polyester yarn are as follows:

TABLE 2

| Yarn Parameters | Yarn Samples with Rollers | Yarn Samples without Rollers |
|---|---|---|
| Denier | 172 | 172 |
| Tenacity (tpd) | 3.8 | 3.77 |
| Elongation (%) | 27.0 | 26.1 |
| Crimp Contraction (%) | 18.5 | 17.5 |
| Tight Spots/100 m. | 5 | 289 |

It will be appreciated from the above test procedures that the method of the present invention substantially reduces the number of tight spots occurring during a false twisting operation, the greatest difference being obtained in those false twist assemblies using spindlettes.

In the procedures using spindlettes, the initial twist inserted is usually from 60 to 80 turns per inch which is the normal range for the processing of such yarns. The tapered flange roller is operated to impart an opposing twist of from 10–20 turns per inch.

Figure 2:
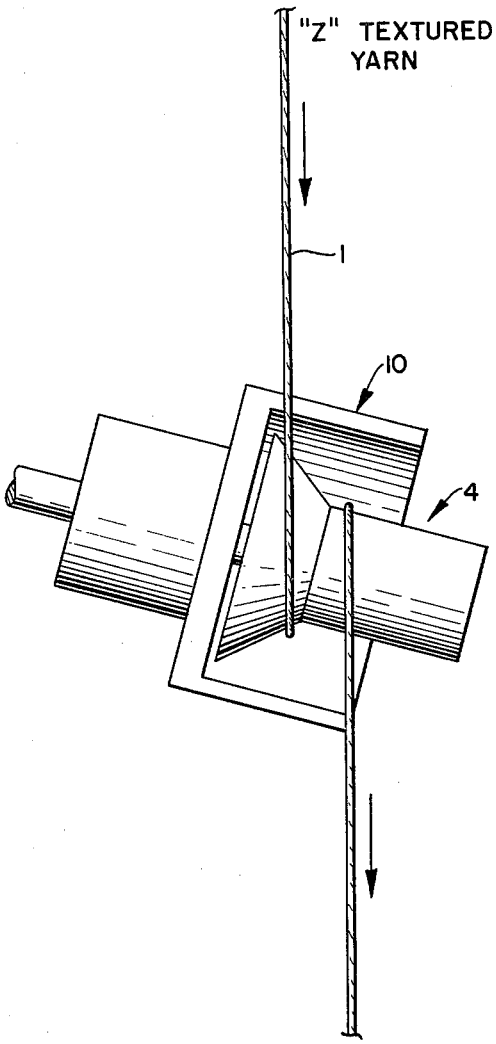
FIG. 2 is a partial side view of the tapered flange roller and associated support provided with a shield for determining the thread-up procedure.
Figure 3:
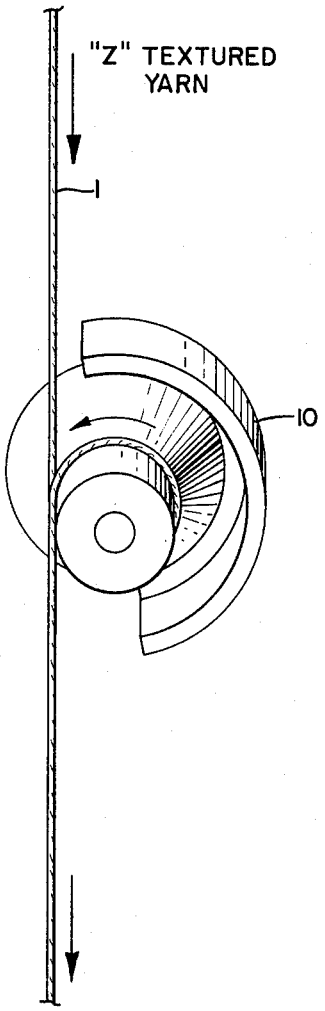
FIG. 3 is a end view of the roller and shield shown in FIG. 2.

In FIG. 2 a shield 10 is shown for preventing improper thread-up of the tapered flange roller in accordance with the present invention. The shield is a semi-cylindrical element which is mounted on a support (which may be the shaft of the roller) so that its axis is concentric to the axis of the tapered flange roller. In the embodiment shown the tapered flange roller is mounted to freely rotate on a shaft within the shield and the right side of the roller, as shown in FIG. 3, is covered so that an operator must thread-up the roller with an "S" twist, that is, counterclockwise, in order to counteract the "Z" false twist initially imparted to the yarn and thereby alleviate the formation of tight spots.

Figure 4:
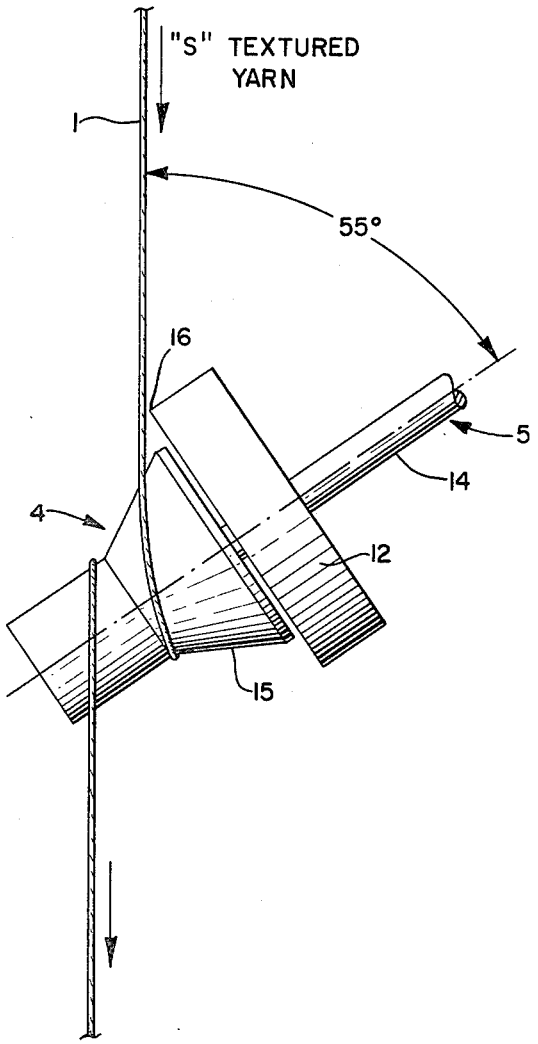
FIG. 4 is a side view showing the arrangement of a stationary disc for preventing yarn from slipping off of the tapered flange portion of the tapered flange roller.

FIG. 4 shows another embodiment of the apparatus of the invention wherein a stationary disc 12 is secured to a shaft 5 for supporting the roller 4 which is provided with roller bearings to freely rotate about the shaft 5. The disc has an outer diameter which is larger than the outer diameter of the tapered flange 15 of the roller. This diameter is preselected so that the outer edge 16 will provide a guide surface for maintaining the yarn 1 at a proper position on the tapered flange 15. It will be recognized that this disc cannot have a diameter sufficiently large to cause the yarn to lift off the tapered flange. Accordingly, the disc must be provided with a diameter predetermined by the diameter of the associated tapered flange, as well as the angular position of the axis of the roller. In general, the disc is made from a high polished hard material so as not to damage the yarn or to provide any other additional frictional forces to the yarn.

In order to further illustrate the torque properties of the yarns that are textured in accordance with the present invention, tapered flange rollers were installed on a FK-5D1 Barmag machine processing 18 points, i.e. 18 yarn positions, using 110/32 polyester yarn. The yarns were false-twisted with and without the rollers and the resulting textured yarns were evaluated for torque and tight spots. Tight spots evaluation involves placing a given length of a yarn sample around a black card in separate wraps and then determining the number of the tight spots by having a technician directly observe and count the tight spots occurring in the yarn.

The torque is measured by the following testing procedure. A yarn sample to be tested is first "cleaned" by removing the first eight yards from the spool the yarn is wound on. The sample yarn end is then held in a manner to retain twist. A 2-meter sample is then folded upon itself, with the folded section suspended downward. A 55 gram weight is hooked into the fold and is suspended thereby. The weight is permitted to rotate so that the folded sample wraps about itself due to to the torque in the yarn.

After the weight rotation has stabilized and is no longer twirling, the weight is rotated in the direction opposite the twist until the loop has been completely untwisted. The number of complete rotations to bring the looped sample to an untwisted condition is referred to as the Liveliness Factor, and is directly proportional to the torque input into the yarn by the false twist texturing process.

In the following table, the letter "c" after the point number indicates results obtained without roller (i.e., control); whereas the letter "s" after the point number indicates results obtained with the roller.

TABLE 3

| Point No. | Denier | Strength(1) | Elongation(2) | Tight Spots(3) | Torque or Liveliness Factor |
|---|---|---|---|---|---|
| 199c | 109 | 3.52 | 28.2 | 28 | 46 |
| 199s | 110 | 3.89 | 20.9 | 0 | 47 |
| 200c | 110 | 3.61 | 28.6 | 22 | 41 |

TABLE 3-continued

| Point No. | Denier | Strength(1) | Elongation(2) | Tight Spots(3) | Torque or Liveliness Factor |
|---|---|---|---|---|---|
| 200s | 110 | 3.05 | 20.9 | 2 | 45 |
| 201c | 109 | 3.53 | 27.3 | 31 | 45 |
| 201s | 110 | 3.19 | 23.2 | 28 | 46 |
| 202c | 106 | 3.68 | 29.6 | 32 | 44 |
| 202s | 110 | 3.03 | 21.9 | 0 | 41 |
| 203c | 109 | 3.41 | 28.0 | 16 | 44 |
| 203s | 109 | 3.21 | 23.7 | 11 | 46 |
| 204c | 110 | 3.51 | 30.1 | 17 | 44 |
| 204s | 109 | 3.26 | 25.3 | 16 | 45 |
| 205c | 109 | 3.57 | 29.2 | 11 | 46 |
| 205s | 110 | 3.12 | 24.4 | 3 | 45 |
| 206c | 110 | 3.48 | 29.5 | 20 | 43 |
| 206s | 111 | 3.14 | 23.8 | 2 | 45 |
| 207c | 110 | 3.60 | 29.8 | 4 | 48 |
| 207s | 111 | 3.30 | 27.5 | 12 | 45 |
| 208c | 110 | 3.48 | 29.5 | 37 | 41 |
| 208s | 110 | 3.16 | 23.8 | 3 | 44 |
| 209c | 108 | 3.71 | 33.1 | 35 | 46 |
| 209s | 108 | 3.46 | 26.8 | 24 | 45 |
| 210c | 110 | 3.60 | 32.5 | 45 | 41 |
| 210s | 110 | 3.07 | 23.3 | 12 | 45 |
| 211c | 109 | 3.67 | 30.1 | 31 | 41 |
| 211s | 110 | 3.10 | 21.7 | 2 | 46 |
| 212c | 110 | 3.49 | 30.4 | 33 | 39 |
| 212s | 111 | 2.93 | 21.8 | 11 | 47 |
| 213c | 110 | 3.39 | 29.9 | 40 | 42 |
| 213s | 110 | 2.98 | 21.3 | 9 | 45 |
| 214c | 111 | 3.55 | 29.5 | 68 | 40 |
| 214s | 112 | 2.89 | 22.4 | 5 | 44 |
| 215c | 109 | 3.38 | 25.6 | 56 | 47 |
| 215s | 110 | 3.12 | 22.7 | 9 | 46 |
| 216c | 109 | 3.65 | 27.9 | 66 | 43 |
| 216s | 110 | 3.03 | 22.5 | 8 | 44 |

(1)grams/denier
(2)%
(3)tight spots/100m.

A summary of the averages is given below:

| | Denier | Strength | Elongation | Tight Spots | Torque or Liveliness Factor |
|---|---|---|---|---|---|
| Control Sample | 109 | 3.56 | 29.3 | 32 | 43.8 |
| (with roller) | 110 | 3.10 | 23.2 | 8 | 45.0 |

It will be seen from the above results that the yarns obtained by using the tapered flange roller of this invention have substantially less tight spots and exhibit torque levels that are usually equal to or greater than those exhibited by the yarns obtained without the rollers.

What is claimed is:

1. A method for alleviating tight spots in false twist textured yarn which comprises, feeding a thermoplastic multi-filament yarn to a false twister, imparting a false twist to the yarn in one direction, setting the twist to provide a torque in the yarn, and then passing the yarn around a tapered flange of a freely rotatable roller to impart a twist in the yarn of a direction opposite to that of the false twist imparted by the twister and of a magnitude sufficient to alleviate tight spots occurring in the yarn during passage through said false twister without substantially reducing said torque.

2. A method according to claim 1 wherein said false twisting of the yarn is effected by passing the yarn initially through a heated twist-setting zone and thereafter passing the yarn from this zone to the false twister that imparts a twist to which backs up opposite to the direction of the yarn travel into the yarn twisting zone, and that causes the original twist imparted to the yarn to disappear as the yarn emerges from the twister.

3. A method according to claim 1 wherein the twist imparted by the tapered flange roller is less than 25% of the false twist imparted to the yarn in the false twister.

4. A method according to claim 1 wherein the yarn is wrapped 360° around the tapered flange roller and the roller is caused to rotate by the yarn passing around said roller, said roller imparting from 10 to 20 turns per inch of twist in said yarn.

5. A method according to claim 1 wherein said tapered flange roller is positioned at a distance of from 1 inch to 6 inches from the false twister.

6. An apparatus for alleviating tight spots in a false twist textured yarn which comprises a false twist assembly including means for feeding the yarn to a twist-setting zone, a false twister for imparting twist to said yarn which backs up opposite to the direction of travel of the yarn into said twist-setting zone, and means for withdrawing the yarn from said false twister; and a tapered flange roller means positioned to freely rotate between the false twister and the yarn withdrawing means for imparting a twist to the yarn which is opposite to the false twist initially imparted to the yarn and set in the twist-setting zone, said twist imparted by said tapered flange roller means being of sufficient magnitude to alleviate tight spots formed in the yarn during passage through said false twister.

7. An apparatus according to claim 6 wherein said direction of travel of the yarn is along a given path between said twister and said yarn withdrawing means, and said roller means includes a tapered flange roller mounted on support means so that the axis of rotation of the roller is at an angle of from 60° to 80° with respect to the path of the yarn emerging from the false twister.

8. An apparatus according to claim 7 wherein the tapered flange roller has a tapered flange at one end with a taper angle of from 25° to 50° and a cylindrical portion at the other end for engaging the yarn and for driving the roller by the passage of yarn around said roller.

9. An apparatus according to claim 7 wherein the yarn is wrapped 360° around the tapered flange roller in a direction to impart the twist opposite to the twist imparted by said false twister.

10. An apparatus according to claim 6 wherein said tapered flange roller means is positioned downstream from said false twister at a distance of from 1 to 6 inches whereby the yarn emerging from said twister immediately is subjected to the twisting action of said tapered flange roller means.

11. An apparatus according to claim 6 wherein said yarn withdrawing means effects withdrawal of the yarn at a rate which is from 1.5:1 to 3:1 of that of said yarn feeding means.

* * * * *